US008932440B2

(12) United States Patent
Shinyama et al.

(10) Patent No.: US 8,932,440 B2
(45) Date of Patent: Jan. 13, 2015

(54) PLATING APPARATUS AND PLATING METHOD

(75) Inventors: Keiji Shinyama, Kariya (JP); Tomoya Uchida, Kariya (JP)

(73) Assignee: Denso Corporation, Kariya (JP)

( * ) Notice: Subject to any disclaimer, the term of this patent is extended or adjusted under 35 U.S.C. 154(b) by 754 days.

(21) Appl. No.: 13/136,826

(22) Filed: Aug. 11, 2011

(65) Prior Publication Data

US 2012/0073979 A1 Mar. 29, 2012

(30) Foreign Application Priority Data

Sep. 24, 2010 (JP) ..... 2010-213944

(51) Int. Cl.

| | |
|---|---|
| ***B23H 11/00*** | (2006.01) |
| ***C25B 9/00*** | (2006.01) |
| ***C25C 7/00*** | (2006.01) |
| ***C25D 17/00*** | (2006.01) |
| ***C25F 7/00*** | (2006.01) |
| ***C25D 21/14*** | (2006.01) |
| ***C25D 21/18*** | (2006.01) |
| ***C25D 5/00*** | (2006.01) |

(52) U.S. Cl.

CPC ..... *C25D 17/00* (2013.01); *C25D 21/14* (2013.01); *C25D 21/18* (2013.01); *C25D 5/003* (2013.01)

USPC ..... 204/275.1; 204/277

(58) Field of Classification Search

CPC ..... C25D 17/00; C25B 9/00; C25B 15/00; C25B 15/08

USPC ..... 204/242, 275.1, 277

See application file for complete search history.

(56) References Cited

U.S. PATENT DOCUMENTS 5,431,801 A * 7/1995 Nishimura et al. ..... 205/88
6,936,142 B2 * 8/2005 Hradil et al. ..... 204/222

(Continued)

FOREIGN PATENT DOCUMENTS

| | | |
|---|---|---|
| CN | 101023204 | 8/2007 |
| EP | 1126512 | 8/2011 |
| JP | 58-189399 | 11/1983 |

(Continued)

OTHER PUBLICATIONS

GEA ("Multi Way Rotary Tube Selector Valves").*

(Continued)

*Primary Examiner* — Luan Van
*Assistant Examiner* — Alexander W Keeling
(74) *Attorney, Agent, or Firm* — Harness, Dickey & Pierce, PLC

(57) ABSTRACT

[Problem] To provide a plating method and apparatus which do not require preparation of a separate treatment tank for each treatment step and therefore enable the facility to be reduced in size and, further, which can reduce the amounts of use of the treatment solutions.

[Solution] A plating apparatus feeding a plating solution to a treatment tank in which an electrode is arranged and plating a workpiece made of a metal so as to perform plating, the plating apparatus characterized by being provided with a plurality of pipes which are connected to an outer wall of the treatment tank and a switch valve which is provided able to rotate at an inner side of the outer wall and which has at least one feed port for making at least one treatment solution feed pipe selected from the plurality of treatment solution feed pipes communicate with the treatment tank.

7 Claims, 6 Drawing Sheets

(56) References Cited

U.S. PATENT DOCUMENTS

| | | | | |
|---|---|---|---|---|
| 2003/0019756 | A1 | 1/2003 | Yoshida et al. | |
| 2006/0185976 | A1 * | 8/2006 | Sendai et al. | 204/275.1 |

FOREIGN PATENT DOCUMENTS

| | | |
|---|---|---|
| JP | 8-031834 | 2/1996 |
| JP | 10-068056 | 3/1998 |
| JP | 2003-179024 | 6/2003 |
| JP | 2010-216006 | 9/2010 |
| WO | WO 02/16673 | 2/2002 |

OTHER PUBLICATIONS

Abe et al. (Machine translation of JP 08-031834).*
Office action dated Aug. 12, 2013 in corresponding Chinese Application No. 2011 10285433.
Office action dated Dec. 4, 2012 in corresponding Japanese Application No. 2010-213944.
Office action dated Feb. 12, 2013 in corresponding Japanese Application No. 2010-213944.

* cited by examiner (a)

(b)

(a)

(b)

PLATING APPARATUS AND PLATING METHOD

TECHNICAL FIELD

The present invention relates to a plating apparatus and a plating method which use the same treatment tank for cleaning and plating in a method of running a current to a workpiece through a plating solution so as to form a plating layer on the surface of the workpiece.

BACKGROUND ART

In the past, various products made of iron, stainless steel, copper, or other metals plated with another metal have been produced. As the products, auto parts, for example, engine parts, electrical and electronic parts, etc. may be mentioned. As the type of plating, zinc plating, nickel plating, copper plating, tin plating, zinc-nickel alloy plating, etc. may be mentioned.

As the system of plating of such products, the immersion system is most generally used. The immersion system is a system where a workpiece made of a metal is immersed as a cathode in a plating tank containing a plating solution and is electrode-reacted with an anode facing the cathode.

The immersion system of plating treatment had the problems accompanying so-called batch processing. That is, for example, as shown in FIG. 1, in pretreatment for hot dip zinc coating, the steps of degreasing, rinsing, pickling, rinsing, and flux treatment became necessary. A separate treatment tank had to be prepared for each of these steps and, with the end of each step, the workpiece had to be conveyed to the next treatment tank. For this reason, the plating facility became extremely large in size. Along with the larger size of the facility, a conveyance apparatus also became necessary. Therefore, there was the problem that the facility easily became higher in cost.

To solve this problem, in, for example, PLT 1, a continuous type chemical surface treatment apparatus comprised of a single work tank and a plurality of storage tanks has been proposed.

However, when providing, for example, a solenoid valve or other mechanism for switching solutions at the outside of a treatment tank, the piping from the switching mechanism to the treatment tank is used in common for the different treatment solutions. An amount of each treatment solution equal to the common piping has to be discharged in order to prevent intermixture, so the amounts of use of the solutions increase.

CITATION LIST

Patent Literature

PLT 1: Japanese Patent Publication (A) No. 10-68056

SUMMARY OF INVENTION

Technical Problem

The present invention was made based on this problem and has as its object to provide a plating method and apparatus which do not require preparation of a separate treatment tank for each treatment step and therefore enable the facility to be reduced in size and, further, which can reduce the amounts of use of the treatment solutions.

Solution to Problem

To achieve the above object, the aspect of the invention of claim 1 provides a plating apparatus plating a metal workpiece 15 with running a current to the metal workpiece 15, comprising: a treatment tank 10 to which a plating solution is fed; a plurality of treatment solution feed pipes connected to an outer wall 20 of the treatment tank 10; a switch valve 30; wherein the switch valve 30 rotates at an inner side of the outer wall 20 and has at least one feed port 31 for making at least one treatment solution feed pipe selected from the plurality of treatment solution feed pipes communicate with the treatment tank 10.

Due to this, by connecting the plurality of treatment solution feed pipes to a single treatment tank 10 and making the switch valve 30 rotate, it is possible to feed a treatment solution which is fed from a selected pipe to the treatment tank 10. As a result, a single treatment tank can be used for consecutive cleaning and plating, so the equipment is reduced in size. Further, the amount of conveyance of a workpiece is kept to a minimum, so the production costs can be reduced. Furthermore, since the switch valve 30 is provided at an inner surface of the outer wall 20 of the treatment tank 10, the pipe which is used in common for the different treatment solutions is kept to a minimum limit and the amounts of the treatment solutions which are discharged for preventing mixture of solutions can be reduced.

The aspect of the invention according to claim 2 provides a plating apparatus further comprising a pressurized gas feed pipe 24 connected to the outer wall 20 of the treatment tank 10, wherein the pressurized gas feed pipe 24 can be switched to be connected to the treatment tank 10 or be disconnected from it by rotating the switch valve 30.

Due to this, it is possible to push out and recover the remaining solution in the treatment tank 10 by pressurized gas. Furthermore, it becomes possible to dry the inside of the treatment tank 10 or a workpiece 15 after plating.

The aspect of the invention according to claim 3 provides a plating apparatus further comprising: a plurality of recovery pipes connected to the outer wall 25 of the treatment tank 10; a switch valve 35 for communicating at least one pipe selected from the plurality of recovery pipes with the treatment tank 10; wherein the switch valve 35 can rotate at an inner side of the outer wall 25.

Due to this, the remaining solution in the treatment tank 10 can be recovered for each treatment solution.

The aspect of the invention according to claim 4 provides a plating apparatus further comprising a plurality of nozzles 40 at an inner side of the switch valve 30.

Due to this, spouted plating, which pressurizes plating solution and sprays it from nozzles 40 so as to spray and hit a workpiece 15, becomes possible.

The aspect of the invention according to claim 5 provides a plating apparatus further comprising an inner surface nozzle 50 for treating an inner surface of the workpiece 15.

Due to this, even the inner surface of the workpiece 15 can be treated in the same way as the outer surface.

The aspect of the invention according to claim 6 provides a plating apparatus wherein an amount of treatment solution which is fed into the treatment tank 10 can be changed by rotating said switch valve 30 and changing a positional relationship between a feed port 31 provided with the switch valve 30 and a pipe for feeding treatment solution.

Due to this, it is possible to change the amount of treatment solution which is fed to the treatment tank 10. Further, when spouted plating, it is possible to change the strength of the spray.

The aspect of the invention according to claim 7 provides a plating apparatus wherein the plurality of nozzles 40 are integrally joined with the switch valve 30 and can rotate simultaneously with the switch valve 30.

By making the nozzles 40 integral with the switch valve 30, it is possible to improve the sealability.

The aspect of the invention according to claim 8 provides a plating method which uses an above plating apparatus, with rotating the switch valve 30, in a single treatment tank 10, comprising the steps of: feeding a cleaning solution into a treatment tank 10 and cleaning a workpiece 15; feeding a pressurized gas into the treatment tank 10 and pushing out and recovering the treatment solution as needed; feeding water to the inside of the treatment tank 10 and rinsing the cleaned workpiece 15; feeding a plating solution to the inside of the treatment tank 10 and plating the rinsed workpiece 15; feeding a pressurized gas into the treatment tank 10 and pushing out and recovering the plating solution; feeding water to the inside of the treatment tank 10 and rinsing the plated workpiece 15; feeding a pressurized gas into the treatment tank 10 and drying the rinsed workpiece 15.

Due to this, a single treatment tank can be used for continuous plating treatment, so treatment in a short time becomes possible. Further, the residual solution is also recovered, so the amounts of use of the treatment solutions can be reduced.

The aspect of the invention according to claim 9 provides the above plating method wherein the plating is spouted plating.

By spouted plating, the amounts of use of the treatment solutions can be reduced.

Note that the above reference numerals are examples showing correspondence with specific embodiments described later.

DESCRIPTION OF EMBODIMENTS

Below, examples of embodiments of the present invention will be explained with reference to the drawings.

Figure 1:
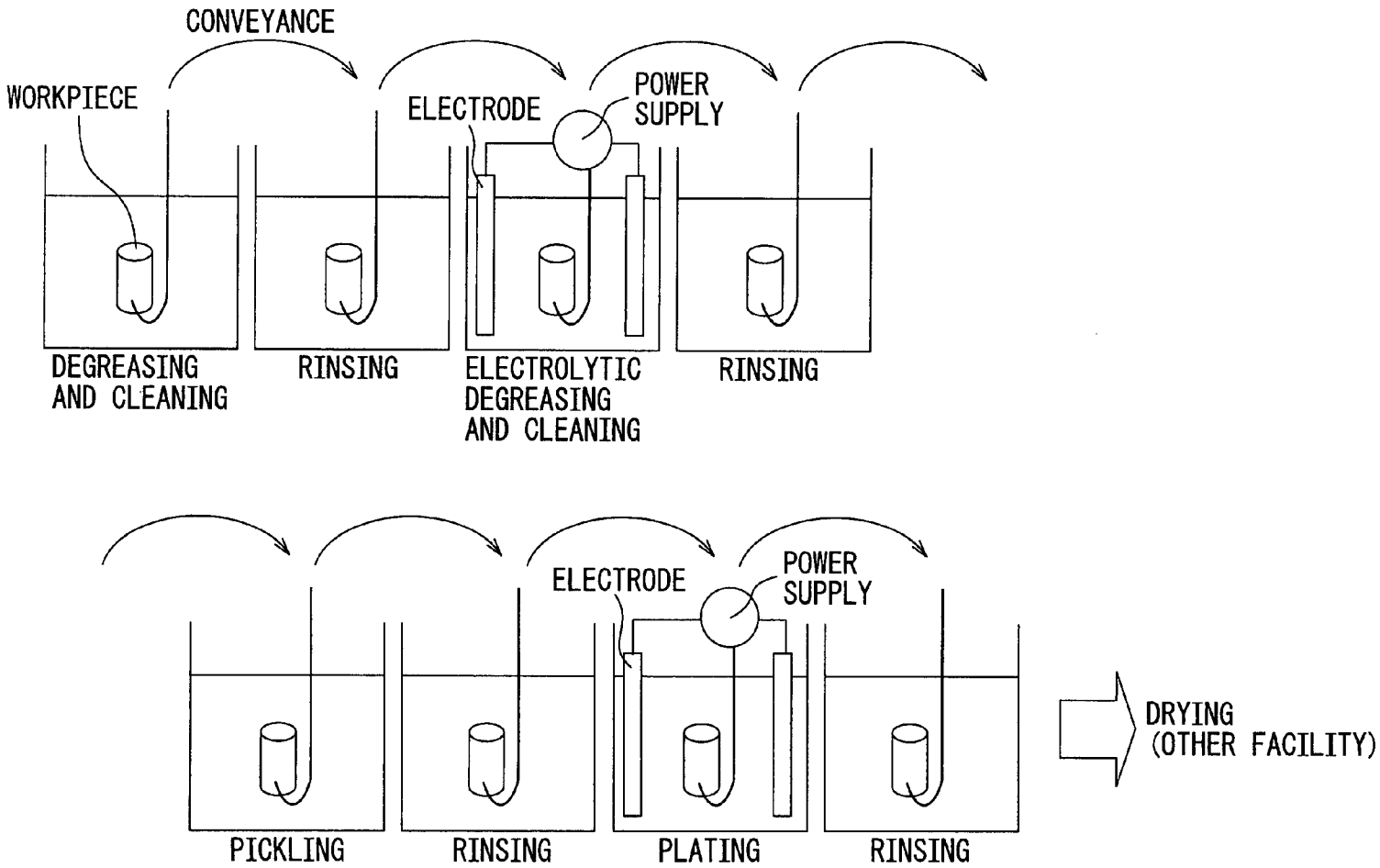
FIG. 1 is a view showing an outline of the flow of plating of a conventional immersion system.
Figure 2:
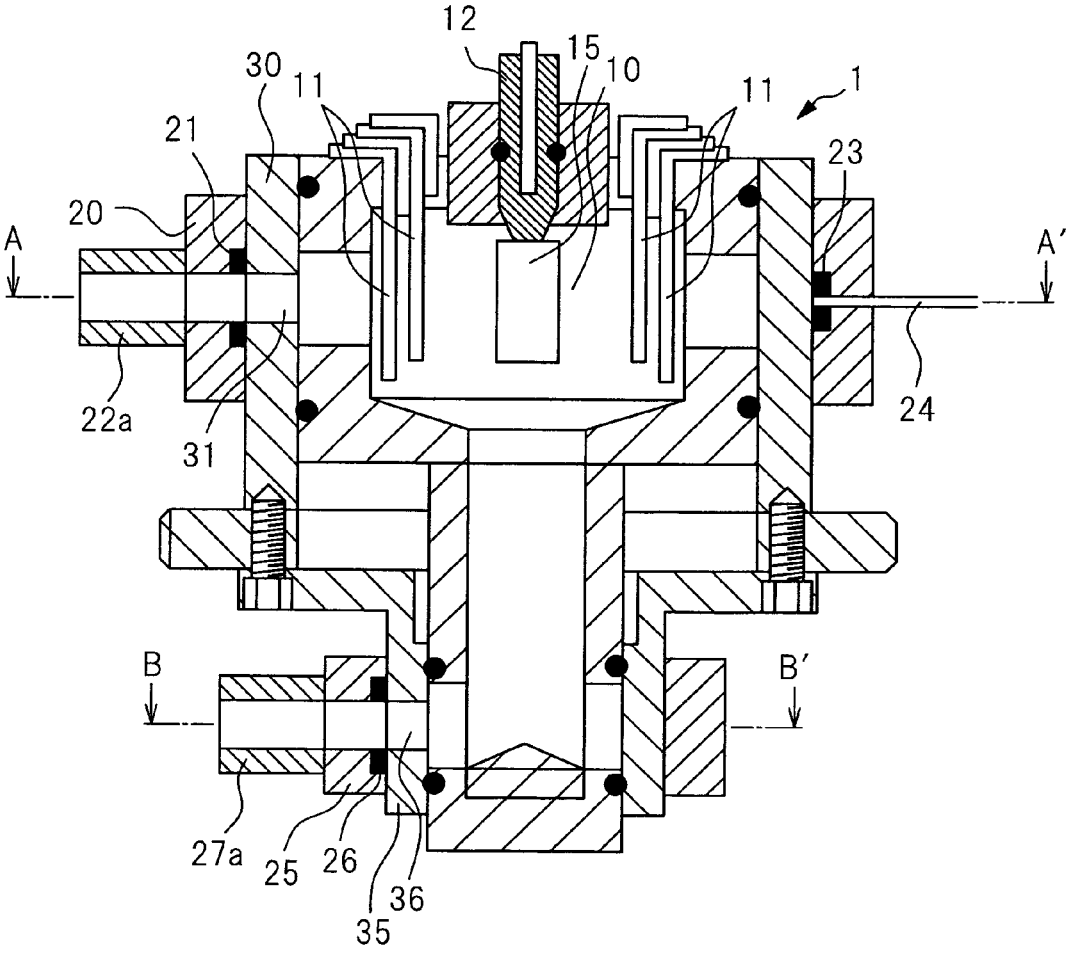
FIG. 2 is a view showing an outline of an example of a plating apparatus according to the present invention.

FIG. 2 is a view schematically showing a plating apparatus of the present invention. A plating apparatus 1 is provided with a treatment tank 10. Above the treatment tank 10, a suspension jig 12 which is connected to a power source (not shown) is used to suspend a workpiece to be plated, that is, a workpiece 15. Inside the treatment tank 10, an electrode 11 which is connected to a power source (not shown) is arranged. Electroplating is possible through this plating solution using the workpiece 15 as a cathode and the electrode 11 as an anode.

The electrode 11 may be made two or more electrodes for cleaning use and plating use or may be made a single common electrode.

At the outer wall 20 above the treatment tank 10, there is a treatment solution feed pipe joint 21. A plurality of treatment solution feed pipes are connected for feeding the treatment solutions used for cleaning, rinsing, and plating to the treatment tank 10, so as plurality of treatment solution feed pipes are connected. At the inner side of the outer wall 20, a switch valve 30 is provided for switching the treatment solution which is fed to the treatment tank 10.

As the treatment solutions, there are, for example, alkali aqueous solutions used for removal of oil and grease, sulfuric acid aqueous solutions used for removal of rust, zinc chloride-ammonia aqueous solutions used for flux treatment, and other cleaning solutions, water used for rinsing, plating solutions used for plating, etc.

Figure 3:
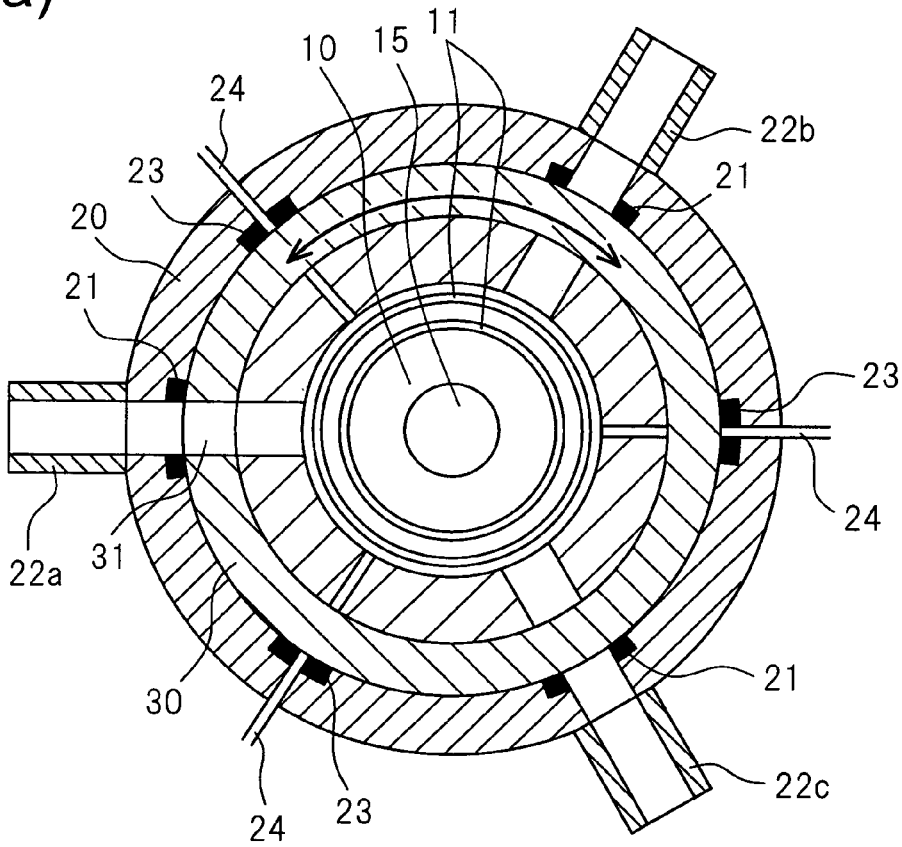
FIG. 3 gives cross-sectional views of a plating apparatus according to the present invention. (a) is a view showing an A-A' cross-section of FIG. 2, while (b) is a view showing a B-B' cross-section of FIG. 2.
Figure 3:
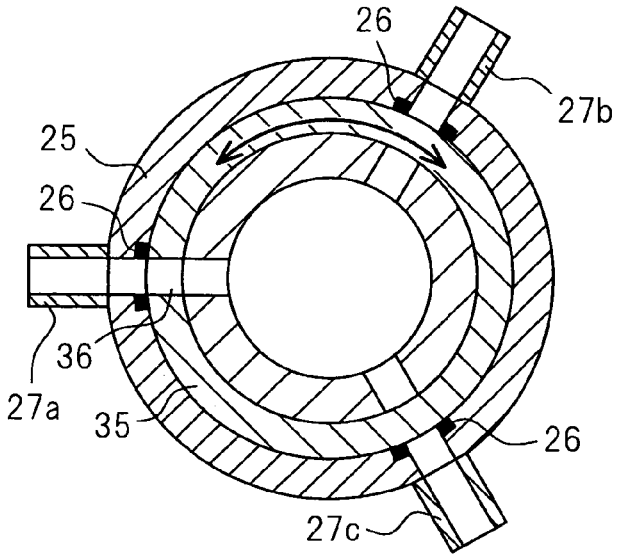

FIG. 3(*a*) is a A-A' cross-sectional view of FIG. 2. In this example, at the outer wall 20, three treatment solution feed pipes 22*a*, 22*b*, 22*c* are connected. The switch valve 30 can rotate. By rotating, the feed port 31 of the switch valve 30 is moved, whereby it is possible to make at least one of the treatment solution feed pipes communicate with the treatment tank 10 and feed only a desired single type of treatment solution to the treatment tank 10.

FIG. 3(*a*) shows an example in which there is only one feed port 31 of the switch valve 30, but it is also possible for the switch valve 30 to have a plurality of feed ports 31 corresponding to the content of treatment and to have a selected plurality of treatment solution feed pipes communicated with the treatment tank 10. Further, the number of the treatment solution feed pipes is not particularly limited.

At the outer side of the outside wall 20, further, it is possible to provide a pressurized gas feed pipe joint 23 and connect to the pressurized gas feed pipe 24. From the pressurized gas feed pipe 24, for example, pressurized air is fed. The pressurized gas feed pipe 24 also can be switched by the switch valve 30 to connection with the treatment tank 10 or disconnection from the same. Due to this, it becomes possible to use pressurized air to push out the remaining solution inside of the treatment tank 10 and recover it using a later explained recovery pipe. Furthermore, the inside of the treatment tank 10 and the workpiece 15 can also be dried. As the pressurized gas, in addition to air, nitrogen, argon, etc. may also be used.

The outer wall 25 of the treatment tank 10 has a recovery pipe joint 26. A recovery pipe for collecting the remainder is connected to it. FIG. 3(*b*) shows a B-B' cross-sectional view of FIG. 2. In this example, at the outer wall 25, three recovery pipes 27*a*, 27*b*, and 27*c* are connected. The recovery pipes correspond to the respective treatment solutions. The switch valve 35 at the bottom of the treatment tank 10 is used to communicate only one pipe to the treatment tank 10 whereby the solution is sent to the respective recovery part (not shown).

In the plating apparatus shown in FIG. 2, the top switch valve 30 and the bottom switch valve 35 are connected and made a simultaneously rotating structure. The recovery pipe corresponding to the solution which is fed and the recovery port 36 of the switch valve 35 are communicated in structure. The two switch valves may also be structured to be able to rotate independently.

In the apparatus of FIG. 2, by feeding the necessary treatment solutions to the treatment tank 10 in the different treatment steps, it is possible to perform plating by the immersion system. To reduce the amount of treatment solution used for a single treatment, it is also possible to provide a valve (not shown) between the top and bottom of the treatment tank 10.

Figure 4:
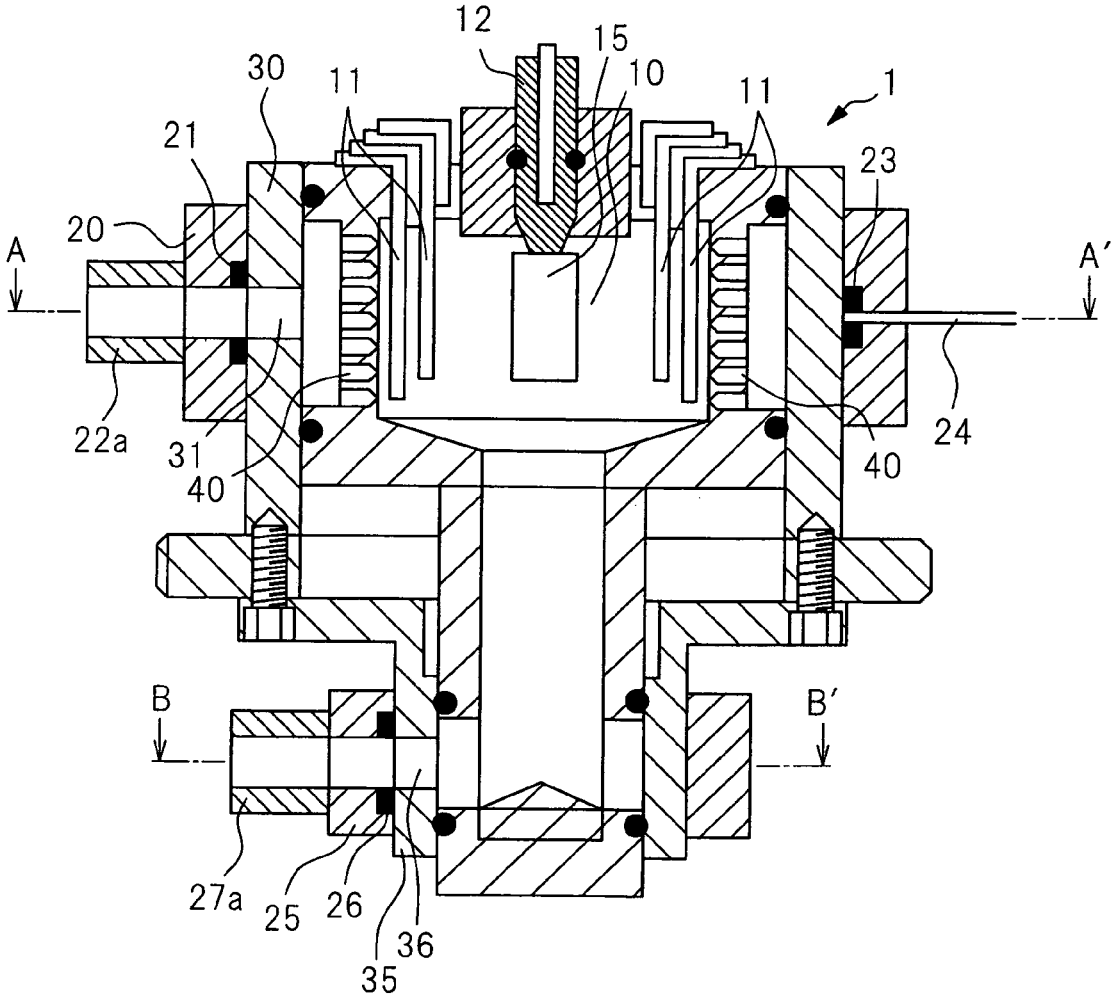
FIG. 4 is a view showing an outline of another example of a plating apparatus according to the present invention.
Figure 5:
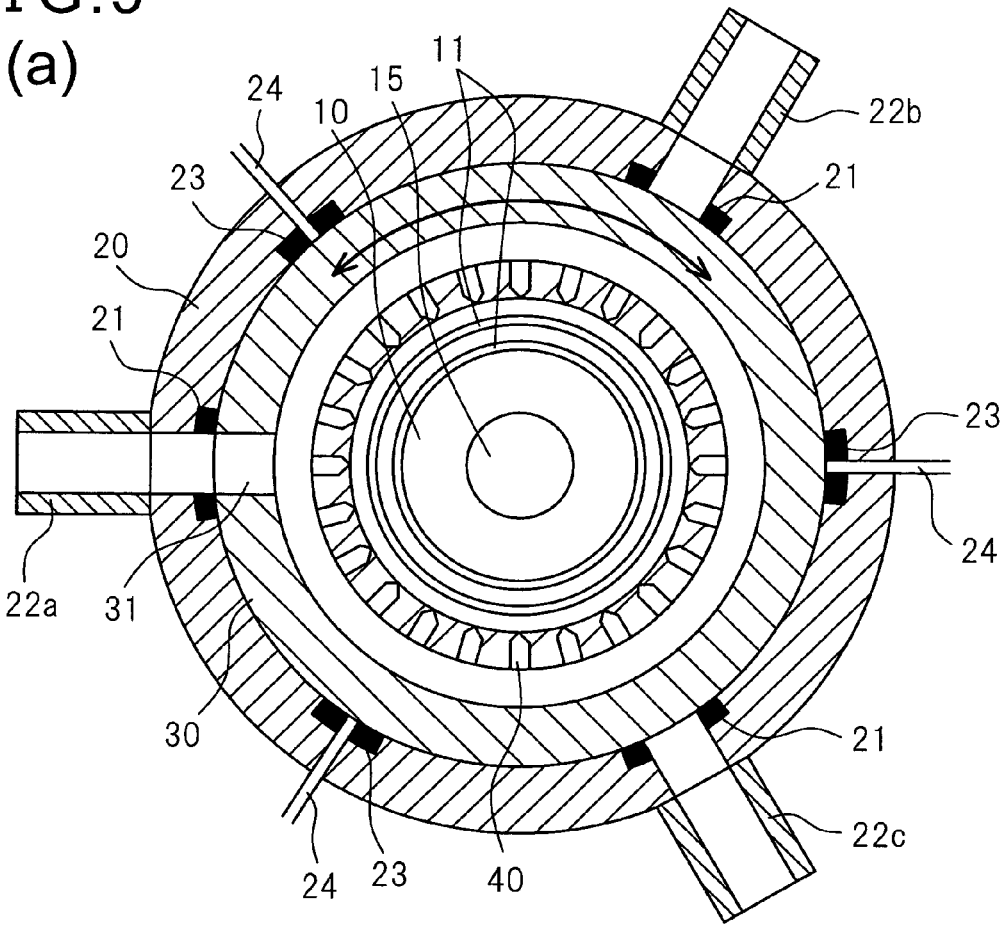
FIG. 5 gives cross-sectional views of a plating apparatus according to the present invention. (a) is a view showing an A-A' cross-section of FIG. 4, while (b) is a view showing a B-B' cross-section of FIG. 4.
Figure 5:
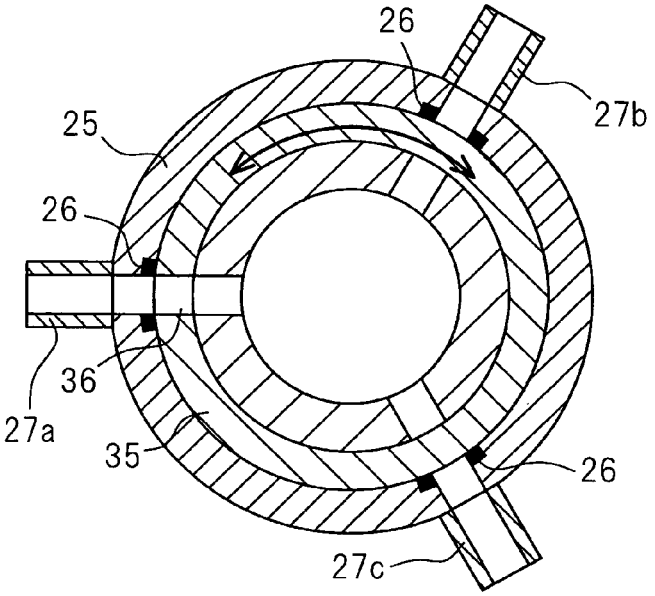

Furthermore, in the apparatus of the present invention, as shown in FIG. 4 and FIG. 5, by providing the nozzles 40 at the inner side of the switch valve 30, spouted plating becomes possible. FIG. 5(*a*) is a view showing an A-A' cross-section of FIG. 4, while (b) is a view showing a B-B' cross-section of FIG. 4. The sizes, pitches, and angles of the nozzles 40, the distances between the nozzles 40 and the workpiece 15, etc. may be suitably set in accordance with the objective.

In the apparatus of the present invention, by changing the positional relationship between the feed port 31 of the switch valve 30 and the treatment solution feed pipes, the amount of the treatment solution which is fed to the treatment tank 10 can be made variable. Due to this, when providing the nozzles 40 and spouted plating, it is also possible to change the strength of the spray.

The nozzles 40, in the same way as the switch valve 30, can be made able to rotate. Further, it is also possible to make the switch valve 30 and the nozzles 40 an integral joined structure to make them simultaneously rotate. From the viewpoint of improving the sealability, the switch valve 30 and the nozzles 40 are preferably made an integrated structure.

Figure 6:
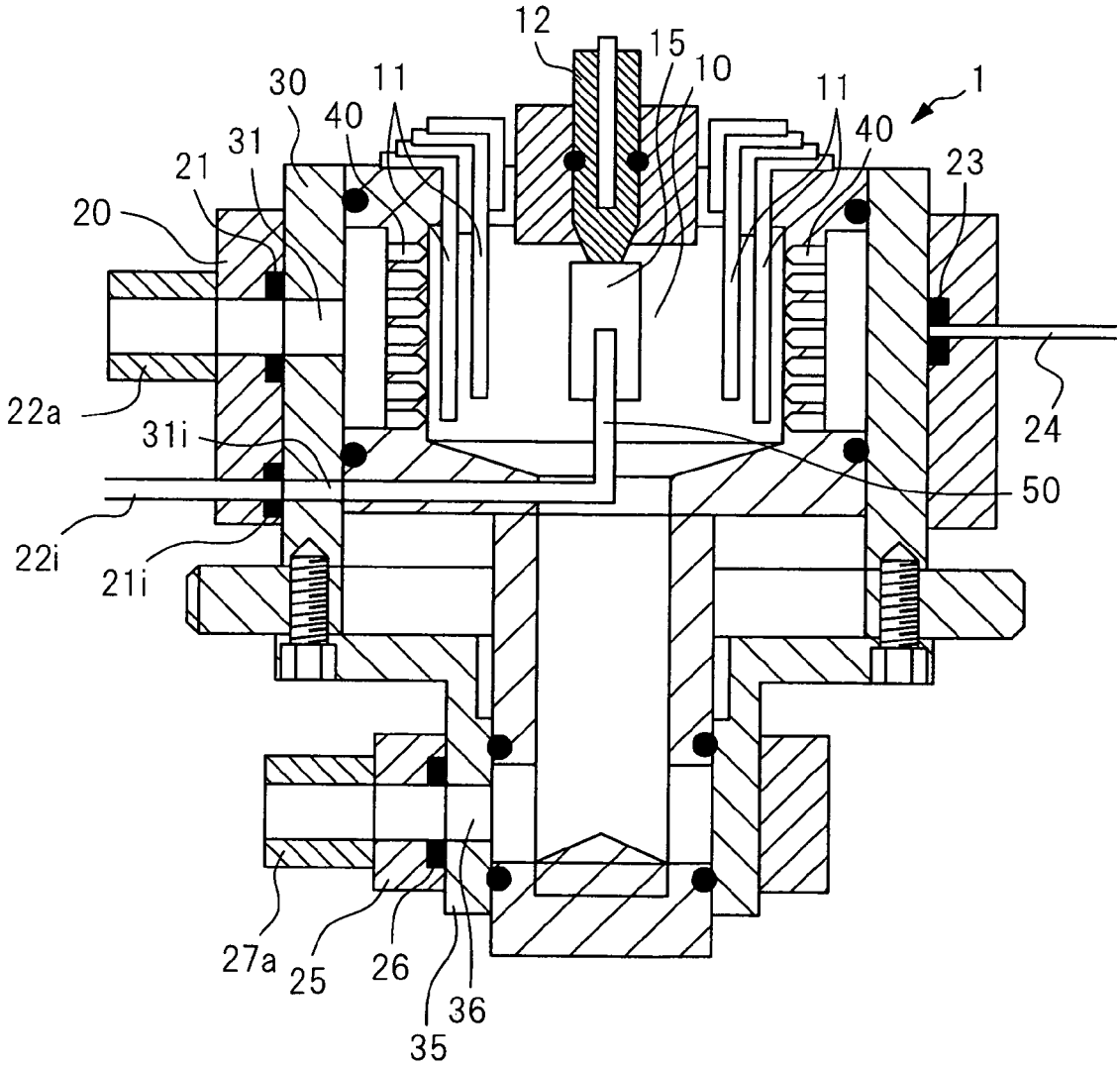
FIG. 6 is a view showing an outline of another example of a plating apparatus according to the present invention.

Further, the plating apparatus of the present invention can be provided with an inner surface nozzle 50 when the workpiece 15 has to be plated at its inner surface. An example of a plating apparatus which is provided with an inner surface nozzle 50 is shown in FIG. 6.

The inner surface nozzle 50 is connected through the feed port 31*i* which is provided at the switch valve 30 and through the treatment solution feed pipe joint 21*i* which is provided at the outer wall 20 to the treatment solution feed pipe 22*i*. Due to this, the inner surface can also be treated at the same time as the outer surface of the workpiece 15 is treated. The inner surface nozzle 50 may also be used as an electrode.

Next, a plating method using the plating apparatus of the present invention will be explained.

The plating method of the present invention is characterized by using the above-mentioned plating apparatus 1 to clean, rinse, plate, and dry a workpiece 15 in the same treatment tank 10.

Below, details of each step will be explained.

The workpiece 15 is connected to a conductive suspension jig 12 and set in the treatment tank 10.

First, the treatment tank 10 is fed with a treatment solution for cleaning use from a treatment solution feed pipe 22*a* to clean the workpiece 15. Next, air is fed from the pressurized gas feed pipe 24 to the inside of the treatment tank 10 to push out the remainder of the treatment solution and recover it from the recovery pipe 27*a*. After this, water is fed from the treatment solution feed pipe 22*b* to rinse the workpiece 15.

As the cleaning of the workpiece, for example, removal of oils and grease by an alkali aqueous solution, removal of rust by sulfuric acid or hydrochloric acid aqueous solution, flux treatment by a zinc chloride-ammonia aqueous solution, etc. may be mentioned.

When a workpiece is cleaned by a plurality of cleaning treatments, with each cleaning treatment, the procedure of rinsing, pushout of the remainder, and rinsing is repeated. A pipe for feeding a cleaning solution is provided for each cleaning solution. It is preferable to feed each cleaning solution from a separate pipe. If the cleaning solutions are treatment solutions where intermixture has no effect, then the rinsing may be omitted and the treatment solution feed pipes may be made common.

Further, even when there is a single type of cleaning treatment, it is possible to provide a plurality of pipes and switch the treatment in accordance with the degree of cleanliness of the workpiece.

After the rinsing, the plating solution is fed from the treatment solution feed pipe 22*c* to plate the workpiece 15. Next, air is fed from the pressurized gas feed pipe 24 to the inside of the treatment tank 10 to push out the remainder of the treatment solution and recover it by the recovery pipe 27*c*. Next, water is fed from the treatment solution feed pipe 22*b* to rinse the plated workpiece 15. After that, air is fed from the pressurized gas feed pipe 24 to dry the workpiece 15.

The plating solution should be fed so as to enable conduction of current between the electrode and the workpiece. If feeding the treatment tank with an amount of plating solution for immersion of the workpiece, plating by immersion becomes possible.

Further, as shown in FIG. 4 and FIG. 5, by providing nozzles at the inside of the switch valve 30 and spraying plating solution from the nozzle holes, spray type plating also becomes possible. If using the spray system, plating becomes possible by less plating solution.

Further, as shown in FIG. 6, by providing the inner surface nozzle 50 in the switch valve 30, it is possible to treat the inner surface of the workpiece 15 at the same time as treating the outer surface.

Furthermore, it is also possible to provide a plurality of pipes for plating use, feed separate plating solutions to these, and therefore form a laminated structure of platings on the workpiece.

As explained above, according to the present invention, it is possible to use a single treatment tank for cleaning, rinsing, plating, and drying, so the facility can be reduced in size. Further, the switch valve is provided inside the treatment tank, so the parts which are used in common for a plurality of treatment solutions can be kept to a minimum and the problem of the increase in the amounts of solutions used for preventing mixture of solutions does not arise. The time for cleaning the parts used in common can also be shortened. Further, by using pressurized air to push out and recover residual solution, it is possible to further reduce the amounts of discharge of solutions.

Further, the apparatus for conveying workpieces also can be streamlined. Further, by just making the switch valve rotate, different treatment can be performed continuously, so the work time can be shortened.

Further, in the conventional cleaning step, for example, in the case of electrolytic cleaning, batch treatment was involved, so there was the problem that the workpieces were superposed over each other and conduction of current to the workpieces became uneven. This was dealt with by extending the cleaning time. According to the present invention, it is possible to treat a workpiece alone, so the necessary electrolytic strength can be directly given to the workpiece and the cleaning time can be shortened.

Note that, the embodiments of the present invention were explained with reference to specific examples, but the present invention is not limited to the above explanation of the invention. Various modifications not departing from the description of the claims and within a range easily conceived of by persons skilled in the art are also included in the present invention needless to say.

EXPLANATION OF REFERENCES

1 plating apparatus
10 treatment tank
11 electrode
12 suspension jig
15 workpiece
20, 25 outer wall
21, 21*i* joints for treatment solution feed pipe
22*a*, 22*b*, 22*c*, 22*i* treatment solution feed pipe

23 joint for pressurized gas feed pipe
24 pressurized gas feed pipe
26 recovery pipe joint
27*a*, 27*b*, 27*c* recovery pipes
30, 35 switch valve
31, 31*i* feed ports
36 recovery port
40 nozzles
50 inner surface nozzle

The invention claimed is:

1. A plating apparatus plating a metal workpiece with running a current to the metal workpiece, comprising:

a treatment tank to which a plating solution is fed;

an electrode arranged in said treatment tank;

a plurality of treatment solution feed pipes connected to an outer wall of said treatment tank;

a switch valve;

wherein said switch valve rotates at an inner side of said outer wall and has at least one feed port for making at least one treatment solution feed pipe selected from said plurality of treatment solution feed pipes communicate with said treatment tank.

2. The plating apparatus as set forth in claim 1, further comprising a pressurized gas feed pipe connected to the outer wall of said treatment tank, wherein said pressurized gas feed pipe can be switched to be connected to said treatment tank or be disconnected from it by rotating said switch valve.

3. The plating apparatus as set forth in claim 1, further comprising:

a plurality of recovery pipes connected the outer wall of said treatment tank;

a switch valve for communicating at least one pipe selected from said plurality of recovery pipes with said treatment tank;

wherein said switch valve can rotate at an inner side of said outer wall.

4. The plating apparatus as set forth in claim 1, further comprising a plurality of nozzles at an inner side of said switch valve.

5. The plating apparatus as set forth in claim 1, further comprising an inner surface nozzle for treating an inner surface of said workpiece.

6. The plating apparatus as set forth in claim 1, wherein an amount of treatment solution which is fed into said treatment tank can be changed by rotating said switch valve and changing a positional relationship between a feed port provided with the switch valve and a pipe for feeding treatment solution.

7. The plating apparatus as set forth in claim 1, wherein a plurality of nozzles are integrally joined with said switch valve and can rotate simultaneously with the switch valve.

* * * * *

UNITED STATES PATENT AND TRADEMARK OFFICE

CERTIFICATE OF CORRECTION

PATENT NO. : 8,932,440 B2
APPLICATION NO. : 13/136826
DATED : January 13, 2015
INVENTOR(S) : Keiji Shinyama et al.

It is certified that error appears in the above-identified patent and that said Letters Patent is hereby corrected as shown below:

In the Claims

Column 8, Claim 3, line 3, after "connected", insert -- to --.

Signed and Sealed this
Twenty-eighth Day of July, 2015

Michelle K. Lee

Michelle K. Lee
*Director of the United States Patent and Trademark Office*